US007434438B2

(12) United States Patent
Kornelsen

(10) Patent No.: US 7,434,438 B2
(45) Date of Patent: Oct. 14, 2008

(54) FOLDING BRAKE

(76) Inventor: Clarence Kornelsen, 117 PR 36194, Sumner, TX (US) 75486

( * ) Notice: Subject to any disclaimer, the term of this patent is extended or adjusted under 35 U.S.C. 154(b) by 110 days.

(21) Appl. No.: 11/476,463

(22) Filed: Jun. 28, 2006

(65) Prior Publication Data

US 2006/0288753 A1 Dec. 28, 2006

Related U.S. Application Data

(60) Provisional application No. 60/694,522, filed on Jun. 28, 2005.

(51) Int. Cl.
*B21D 5/04* (2006.01)
*B21D 43/00* (2006.01)

(52) U.S. Cl. ..... 72/319; 72/420; 414/917

(58) Field of Classification Search ..... 72/319–312, 72/389.3, 389.6, 420; 254/8 B, 10 B; 414/917, 414/680

See application file for complete search history.

(56) References Cited

U.S. PATENT DOCUMENTS

| | | | | | |
|---|---|---|---|---|---|
| 1,067,167 | A | * | 7/1913 | Dreisvogt | 72/319 |
| 1,889,521 | A | * | 11/1932 | Anthony et al. | 414/751.1 |
| 1,935,173 | A | * | 11/1933 | Anthony et al. | 72/20.2 |
| 2,283,012 | A | * | 5/1942 | Nightingale | 72/319 |
| 2,343,441 | A | * | 3/1944 | Babcock et al. | 72/319 |
| 2,368,478 | A | * | 1/1945 | Landweir | 72/420 |
| 3,359,771 | A | * | 12/1967 | Meyerchick, Jr. | 72/319 |
| 4,185,487 | A | * | 1/1980 | Merideth | 72/315 |
| 4,479,632 | A | * | 10/1984 | McIntire et al. | 254/3 B |
| 4,594,867 | A | | 6/1986 | Andersen | |
| 4,765,171 | A | | 8/1988 | Klingesberger | |
| 4,836,004 | A | | 6/1989 | Codatto | |
| 4,843,862 | A | * | 7/1989 | Salvagnini | 72/319 |
| 4,875,356 | A | * | 10/1989 | Boardman et al. | 72/321 |
| 5,295,384 | A | | 3/1994 | Schubert | |
| 5,694,801 | A | * | 12/1997 | Takahashi et al. | 72/319 |
| 6,167,740 | B1 | * | 1/2001 | Lipari et al. | 72/306 |
| 7,377,741 | B2 | * | 5/2008 | Hall | 414/685 |
| 2003/0033845 | A1 | | 2/2003 | Forlow | |

* cited by examiner

*Primary Examiner*—Daniel C Crane
(74) *Attorney, Agent, or Firm*—James Ray & Assoc.

(57) ABSTRACT

A folding brake includes a frame having a pair of vertically disposed and spaced side members and a lower clamp member rigidly attached to each side member and disposed in a horizontal plane. An upper clamp member is pivotally positioned in relationship to the lower clamp member for selectively clamping a workpiece positioned thereon. A first drive member generates a clamping force and selectively moves the upper clamp member. A pivotally mounted bend rail is engageable with a portion of such workpiece protruding beyond a front edge of the lower clamp member. A second drive member generates a bending force and selectively pivots the bend rail in a first direction to apply the bending force to such workpiece and in a second direction to disengage the workpiece. A controller is provided for operating the first and second drive members.

20 Claims, 4 Drawing Sheets

FOLDING BRAKE

CROSS-REFERENCE TO RELATED APPLICATIONS

This application is related to and claims priority from Provisional Patent Application Ser. No. 60/694,522 filed Jun. 28, 2005.

FIELD OF THE INVENTION

The present invention relates, in general, to metal bending machines and, more particularly, this invention relates to a folding brake employing a rotating bending beam to bend a projecting portion of a workpiece which is clamped between upper and lower clamping members.

BACKGROUND OF THE INVENTION

A common problem encountered in bending a metal workpiece using conventional brake equipment having a vertically moving ram or bed is that both sides of the workpiece rotate upwardly about the bend line. The wider side must be supported during such upward rotation in order to maintain accuracy of the bend. Furthermore, the workpiece is positioned and supported within such conventional brake equipment and may shift during the bending process due to applied force thus further affecting the quality of the bend. The problem is particularly felt when bending a wide workpiece with a thickness greater than 10 gauge.

Another type of brake equipment where the workpiece is clamped between lower and upper clamp means and wherein bending of the workpiece is performed by a rotating bending member and only a portion of such workpiece protrudes beyond the front edges of the upper and lower clamp means is bent upwardly is generally applicable to a light workpiece with a thickness of less than or equal to 10 gauge. The presently available construction method of such brake equipment is not suitable for adaptation for bending a workpiece with a thickness greater than 10 gauge.

SUMMARY OF THE INVENTION

According to a first embodiment, the invention provides a folding brake that includes a frame having a pair of vertically disposed and spaced side members. A lower clamp member is rigidly attached to each side member and is disposed in a horizontal plane. An upper clamp member is movably positioned in relationship to the lower clamp member for selectively clamping a workpiece positioned thereon. A first pivot member is provided for pivotally attaching a predetermined portion of the upper clamp member to a rear portion of the frame. A first drive member generates a clamping force and pivotally moves the upper clamp member between a first position wherein a predetermined portion of the upper clamp member abuts such workpiece positioned on the lower clamp member and applies the clamping force thereto and a second position wherein the predetermined portion of the upper clamp member is disposed at a predetermined distance from such workpiece for enabling selective positioning of such workpiece within the folding brake. A bending member is engageable with a portion of such workpiece protruding beyond a front edge of the lower clamp member. A second pivot member pivotally attaches the bending member to the frame. A second drive member generates a bending force and pivots the bending member in a first direction to engage such protruding portion of such workpiece and apply the bending force thereto and in a second direction to disengage the bending member from such bent portion of such workpiece. A control member is provided for operating the first drive member and the second drive member.

According to a second embodiment of the invention, there is provided an improvement in combination with a folding brake wherein a bending of a workpiece clamped between lower and upper clamp members is performed by a movable bending member. The improvement includes a hoist for at least one of moving and positioning such workpiece.

OBJECTS OF THE INVENTION

It is, therefore, one of the primary objects of the present invention to provide a folding brake for forming a bend in a workpiece.

Another object of the present invention is to provide a folding brake which is capable of bending a workpiece having a wide range of thicknesses.

Yet another object of the present invention is to provide a folding brake which is hydraulically operable.

A further object of the present invention is to provide a folding brake which is capable of clamping the workpiece prior to bending.

Yet a further object of the present invention is to provide a folding brake which incorporates a rotating bending member.

An additional object of the present invention is to provide a folding brake which employs a hoist for positioning the workpiece for bending.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
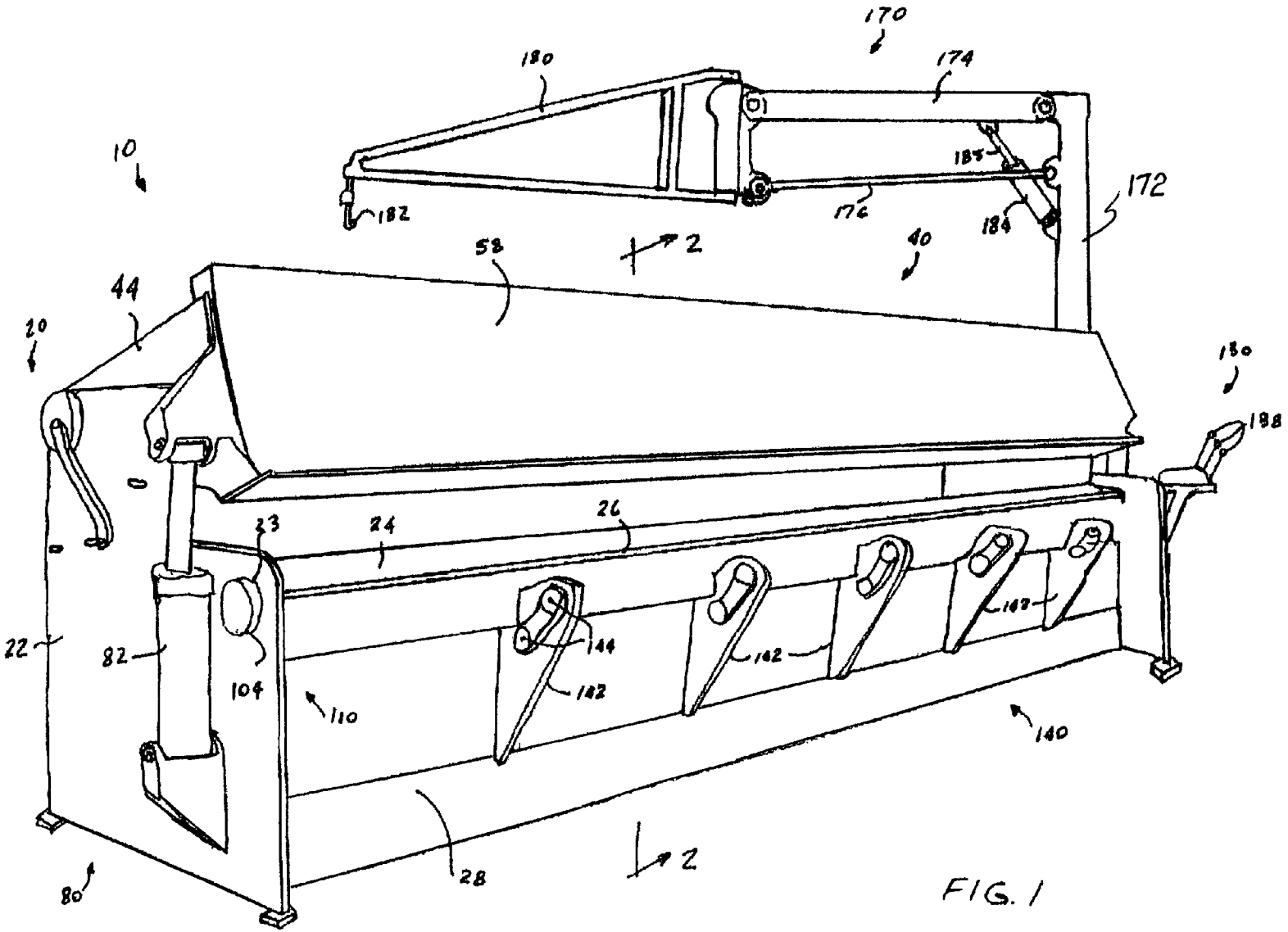
FIG. 1 is a perspective view of a folding brake of the present invention.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-6, wherein there is shown a folding brake, generally designated 10, for forming bends in a workpiece 2. Now in particular reference to FIGS.

1-2, the folding brake 10 includes a frame, generally designated 20, having a pair of parallel side members 22 spaced from each other at a predetermined distance.

A plate like member 24 is rigidly attached to each of the side members 22 and is disposed in a horizontal plane. Such plate like member 24 forms a lower clamp means. A second vertically disposed plate like member 28 is rigidly attached to each side member 22 adjacent a front edge thereof and is further rigidly attached to a bottom surface of the lower clamp means 24 and is positioned at a predetermined distance from the front edge 26 of lower clamp means 24. Optional cross members 30, 32 and 34 may be provided for increasing a structural rigidity of the frame 20.

An upper clamp means, generally designated 40, is movably positioned in relationship to the lower clamp means 24 for selectively clamping the workpiece positioned on the lower clamp means 24. In the presently preferred embodiment of the invention, such upper clamp means 40 includes an elongated member 42 which is disposed generally horizontally between the pair of side members 22 of the frame 20 and adjacent the upper rear corner of each side member 22.

A vertically disposed side member 44 is rigidly attached to the elongated member 42 at each end thereof. A first plate like member 46 has a rear edge 48 rigidly attached to the elongated member 42 and has each side edge rigidly attached to a respective one of the side members 44 of upper clamp means 40.

A clamp member 54 is rigidly attached to a front edge 50 of the first plate like member 46 and has at least a front edge 56 thereof abutting a portion of such workpiece 2 when the upper clamp means 40 is disposed in a first position. Preferably, such clamp member 54 is formed as a plate like member 54. The front edge 56 is preferably beveled in a direction away form the lower clamp means 24.

In order to accommodate a thicker and longer workpiece 2 the upper clamp means 40 may include an optional second plate like member 58 having a bottom edge rigidly attached to the clamp member 56 and having each side edge rigidly attached to the respective one of the pair of side members 44 of the upper claim means 40. A top brace 60 preferably closes the upper clamp means 40 and is rigidly attached to the elongated member 42, side members 44 and the second plate like member 58. Furthermore, the upper clamp means 40 may include a plurality of optional stiffeners 62 rigidly attached to elongated member 42, the first plate like member 46 and the optional second plate like member 58.

The folding brake 10 further includes a first pivot means, generally designated 70 for pivotally attaching a predetermined portion of the upper clamp means 40 to a rear portion of the frame 20. Preferably, such predetermined portion is the elongated member 42 and such first pivot means 70 includes a pair of bearing 72 each secured to a respective one of the pair of side members 22 of the frame 20 and at least opposed ends 43 of the elongated member 42 have a round cross-section and operatively engage a respective bearing 72.

A first drive means, generally designated 80, is provided for generating a clamping force and pivotally moving the upper clamp means 40 between such first position wherein a predetermined portion of the upper clamp means 40, such as a clamp member 54, abuts such workpiece 2 positioned on the lower clamp means 24 and applies the clamping force thereto and a second position wherein the clamp member 54 is disposed at a predetermined distance from such workpiece 2 for releasing the workpiece 2 and for enabling selective positioning thereof within the folding brake 10.

In the presently preferred embodiment of the invention, such first drive means 80 includes a pair of cylinders 82 each mounted external to a respective one of such pair of side members 24 and pivotally attached thereto at one end and pivotally attached to the upper clamp means 40 at a distal end. Preferably, each cylinder 82 is a hydraulic cylinder of a double-acting type, and the folding brake 10 further includes a pump means 84 for selectively supplying a hydraulic fluid to each cylinder 82.

A bending means, generally designated 90, is positioned adjacent a front edge 26 of the lower clamping means 26 and is engageable with a portion of such workpiece 2 protruding beyond the front edge 26 of the lower clamp means 24. A second pivot means, generally designated 100, is provided for pivotal attachment of the bending means 90 to the frame 20. And a second drive means, generally designated 110, is provided for generating a bending force and pivoting the bending means 90 to form the bend in the portion of the workpiece 2 protruding beyond the front edge 26 of the lower clamp means 24 by rotating such protruding portion upwardly and in a counter-clockwise direction as viewed in FIG. 2

According to one embodiment of the invention, the bending means 90 includes a bend rail 92. The second pivot means 100 includes an elongated member 102 rigidly attached to the bend rail 92 and has at least each end thereof formed with a round cross-section. A pair of bearings 104 are provided, each receiving a respective end of the elongated member 102. Preferably, each bearing 104 is secured to the exterior surface of side member 22 which further includes an aperture 23 aligned with the bearing 104 for enabling passage of the respective end of the elongated member 102.

The second drive means 110 includes an elongated member 112 rigidly attached to a rear portion of each side member 22 of the frame 20 and at least one cylinder 114 pivotally connected to the elongated member 112 at one end and pivotally connected to the elongated member 102 at a second end. Each cylinder 114 is a double-acting hydraulic cylinder 114 being connected to the pump means 84. Preferably, a longitudinal axis of the at least one cylinder 114 is perpendicular to a longitudinal axis of the elongated member 112.

Figure 2:
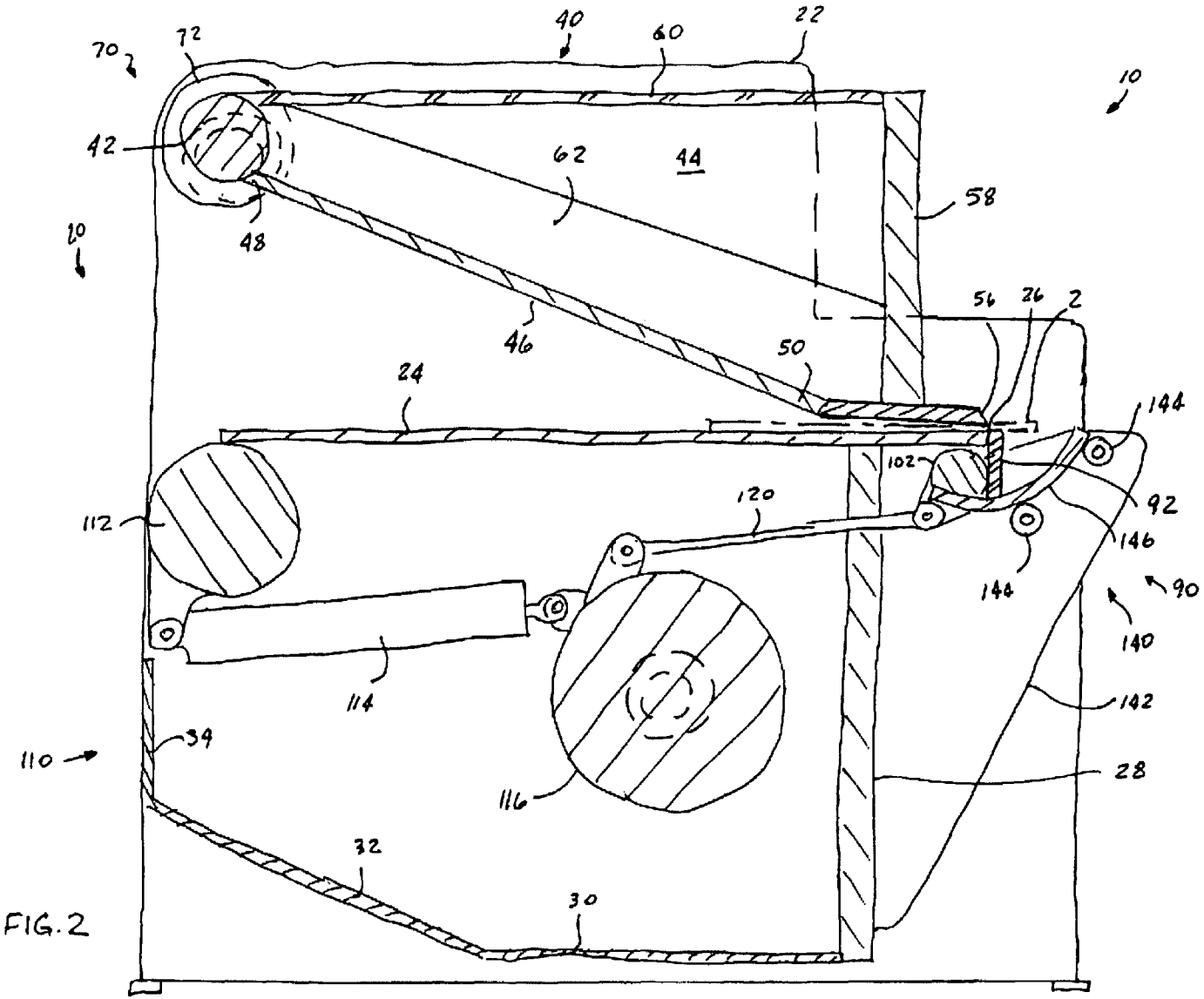
FIG. 2 is a cross-sectional view of the folding brake taken along the lines 2-2 of FIG. 1.

According to another embodiment of the invention, best shown in FIG. 2, the bending means 90 further includes a second elongated member 116 pivotally connected to each side member 22. In this embodiment of the invention, the second end of such at least one cylinder 112 is pivotally connected to such second elongated member 116. Furthermore, at least one arm member 120 has a first end thereof pivotally connected to the second elongated member 116 and has a second end thereof pivotally connected to elongated member 102 of the second pivot means 100. Longitudinal axis of the at least one arm member 120 is perpendicular to a longitudinal axis of the elongated member 102 and the second elongated member 116.

Figure 3:
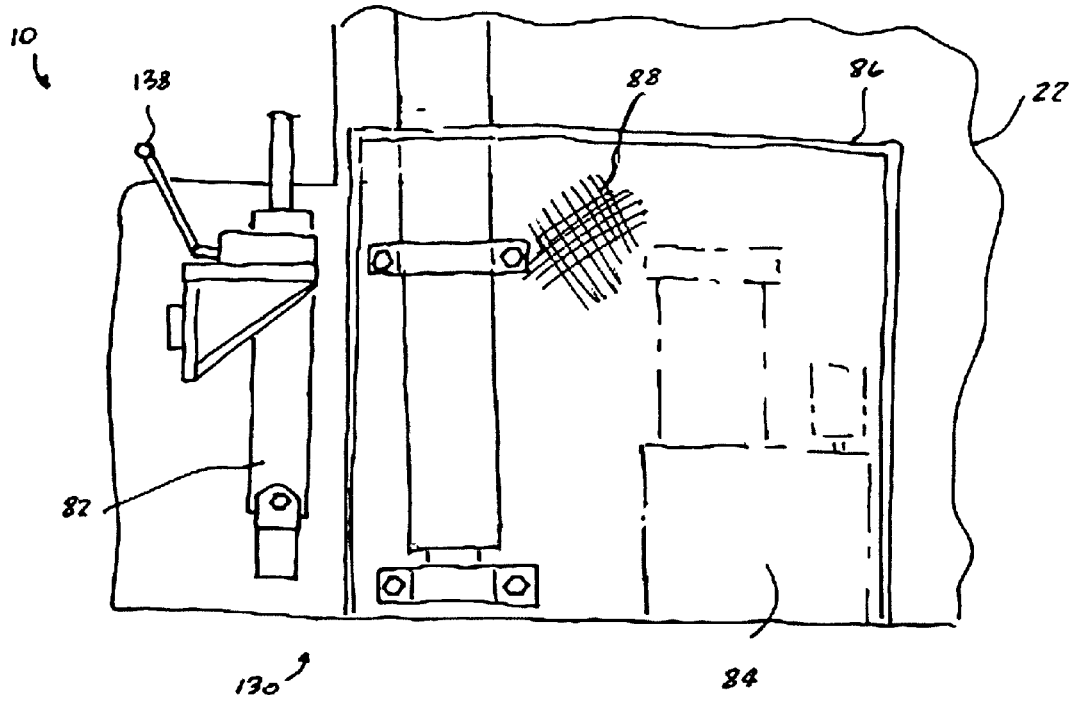
FIG. 3 is a partial side elevation view of the folding brake of FIG. 1 illustrating control apparatus of the present invention.
Figure 4:
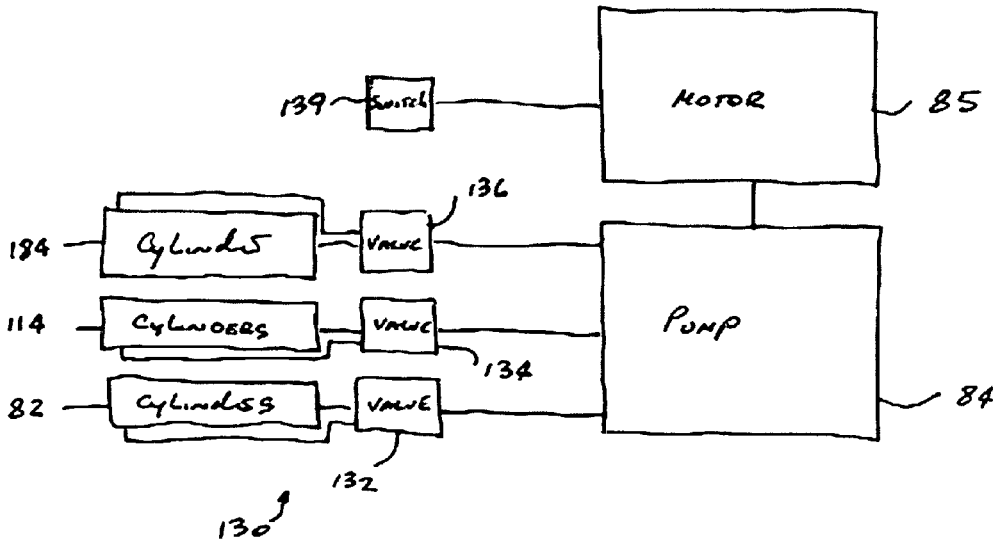
FIG. 4 is a schematic diagram of the control apparatus of FIG. 3.

Now in particular reference to FIGS. 3-4, the folding brake 10 additionally includes a control means, generally designated 130, for operating the first drive means 80 and the second drive means 110. When each of such drive means includes at least one hydraulic cylinder, the control means 130 includes a first flow control valve 132 for selectively supplying hydraulic fluid pressure generated by the pump means 84 to the pair of cylinders 82 and a second flow control valve 134 for selectively supplying hydraulic fluid pressure generated by the pump means 84 to the cylinder 114. Each valve 132, 134 is manually operable by way of a lever 138.

Preferably, the pump 84 is operated by an electric motor 85 and the control means 130 further includes a switch 139 for selectively operating such electric motor 85. It is further preferred for the pump means 84 and the electric motor 85 to be disposed within the enclosure 86 having a door 88 manufactured from a mesh material. Furthermore, at least one bypass valve (not shown) is provided for bypassing the fluid pressure flow to the cylinders.

In operation, the workpiece 2 is placed onto the lower clamp means 24 and a portion thereof is positioned to protrude beyond its front edge 26. The first control valve 132 is manually operated into a first position to introduce fluid pressure into the rod side of each cylinder 82 in order to move the upper clamp means 44 into the first position for clamping the workpiece 2. Then, the second control valve 134 is manually operated into the first position to introduce fluid pressure into the piston side of each cylinder 114 enabling extension thereof and rotation of the bend rail 92 in the counter-clockwise direction as viewed in FIG. 2 for bending the protruding portion of the workpiece 2 in the upward direction.

When desired bending has been achieved, the second control valve 134 is manually operated into the second position to introduce fluid pressure into the rod side of each cylinder 114 enabling retraction thereof and, more particularly, enabling rotation of the bend rail 92 in a clockwise direction to disengage workpiece 2. Then, the first control valve 132 is manually operated into the second position to introduce fluid pressure into the piston side of each cylinder 82 enabling extension thereof and, more particularly, enabling movement of the upper clamp means 40 into the second position for removing the clamping pressure acting on the workpiece 2. The workpiece 2 can be removed from the folding brake 10 or may be repositioned for additional bending.

It will be apparent to those skilled in the art that thickness and size of each structural component of the folding brake 10 and selection of the pump means 84 and cylinders 82 and 114 will be determined based on the length and thickness of the workpiece 2 to be bent. Furthermore, it is presently preferred that material of each structural component is metal, such as steel.

The presently preferred embodiment of the invention contemplates that folding brake 10 is capable of bending a workpiece 2 having a thickness of equal to or less than 0.25 inches and having a length of about 20 feet. Accordingly, the thickness of each side frame has been determined to be about 0.88 inches and the thickness of the lower clamp means 24 has been determined to be about 1 inch. The elongated member 42 of the upper clamp means 40 has been selected to have a 4.0 inch diameter.

It has been determined that in order to form a 90 degree bend in a workpiece having a thickness of about 0.25 inches, five cylinders 114 are desirable in the construction of the folding brake 10, each having a 3.0 inch diameter piston and a 12.0 inch stroke. It will be appreciated that the quantity of the cylinders 114 will be reduced if a maximum length of workpiece 2 is less than 20 feet and will be increased if the maximum length of the workpiece 2 exceeds 20 feet.

It has been further determined that adapting the second drive means 110 with the second elongated member 116 connected intermediate the plurality of cylinders 114 and the bend rail 92 equally distributes the bending force generated by such cylinders 114 along the entire length of the bend rail 92.

Now in further reference to FIGS. 1-2, the folding brake 10 may include a guide means, generally designated 140, for guiding rotational movement of the bending means 90 during bending of such portion of such workpiece 2 projecting beyond the front edge 26 of the lower clamp means 24. In the presently preferred embodiment of the invention, such guide means 140 includes a plurality of support members 142 each rigidly attached to the frame 20 and, more particularly, to the plate like member 28.

Each support member 142 is adapted to support a pair of bearings 144. Each bearing 144 is radially mounted in relationship to the front edge 26 of the lower clamp means 24 and has an axis of rotation disposed substantially parallel to such front edge 26. A plurality of arcuate guide members 146 are provided, wherein each guide member 146 is rigidly attached to the bend rail 92 and to the elongated member 102 of the second pivot means 100 and is operatively engageable with each of such pair of bearings 144.

As it has been determined, such guide means 140 is advantageous for equally applying the generated bending force to the workpiece 2 and along the entire length thereof during the rotation of the bend rail 92.

Figure 6:
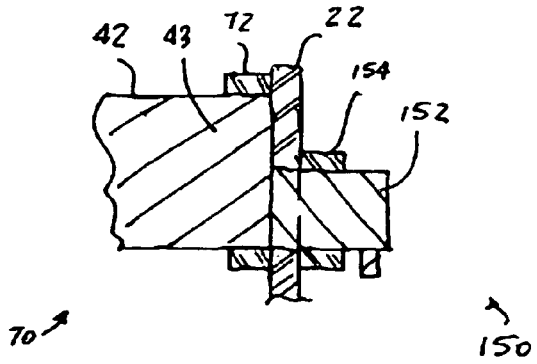
FIG. 6 is a partial cross-sectional view of the workpiece thickness adjustment assembly taken along the lines 6-6 of FIG. 5.
Figure 5:
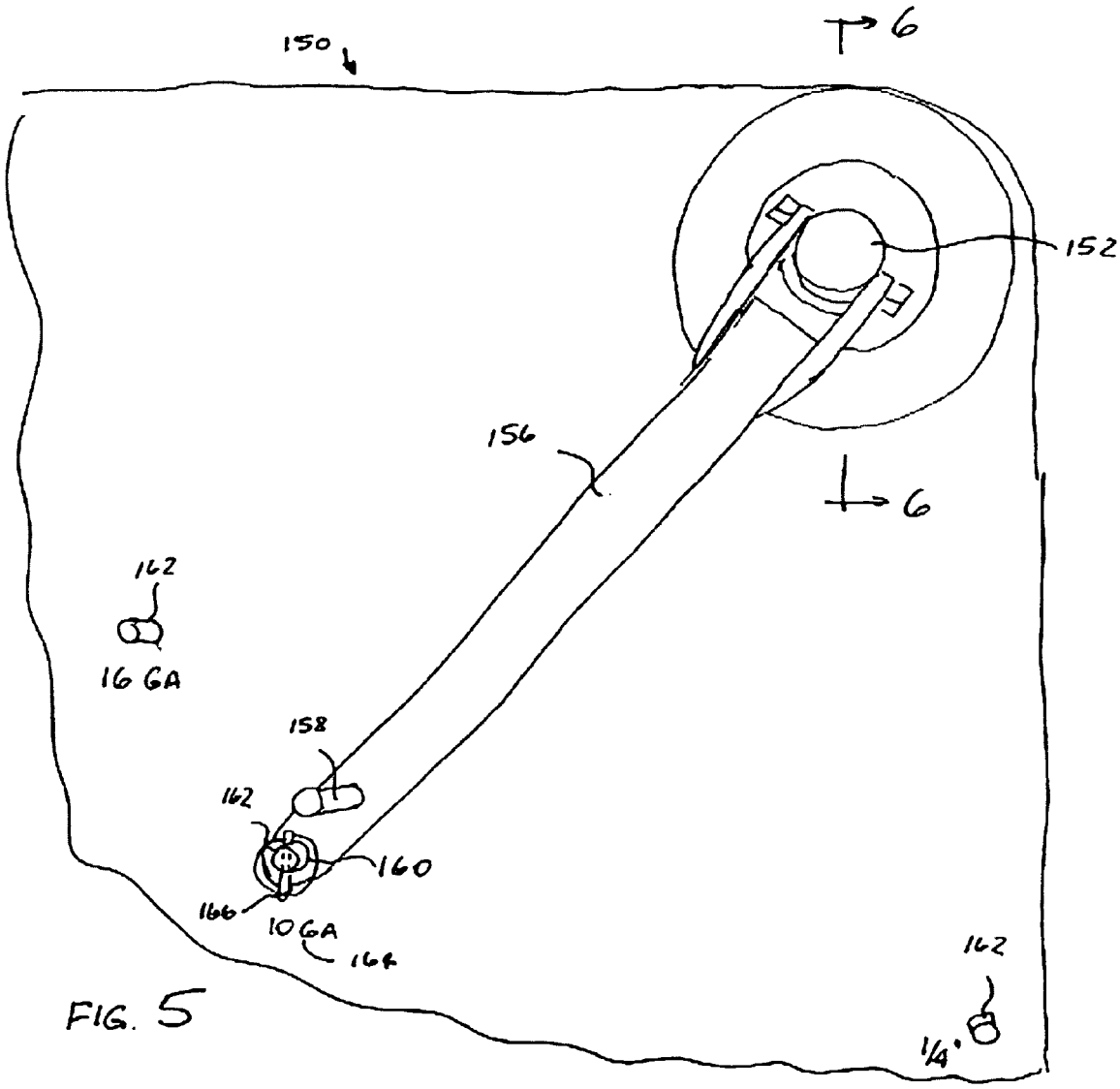
FIG. 5 is a partial side elevation view of the folding brake of FIG. 1 illustrating a workpiece thickness adjustment assembly of the present invention.

Now in reference to FIGS. 5-6, the folding brake 10 may also include a pair of optional means, generally designated 150, for adjusting a position of the upper clamp means 40 due to a thickness of workpiece 2.

In the presently preferred embodiment of the invention, each of such thickness adjustment means 150 is disposed external to a respective one of the pair of side members 22 and includes end 43 of elongated member 42 of the upper clamp means 40 having an eccentrically machined shaft portion 152.

Accordingly, the folding brake 10 includes a pair of bearings 154, each secured to an exterior surface of the side members 22 for operatively receiving a respective one of the pair of shaft portions 152. An elongated lever 156 has a first end thereof secured to the end of the shaft portion 152 protruding beyond the exterior surface of the side member 22 in an arrangement wherein such lever 156 rotates the elongated member 42 about its longitudinal axis and wherein the lever 156 is pivotal about such shaft portion 152 away and towards the exterior surface of the side member 22.

The second opposed end of the lever 156 is fitted with a handle 158 for manually operating lever 156. An aperture 160 is also disposed adjacent the second end of the lever 156. A plurality of positioning pins 162 are rigidly secured to the exterior surface of the side member 22 and are radially disposed in relationship to the rotational longitudinal axis of the shaft portion 152. Each positioning pin 162 is attached in a predetermined position and extends outwardly and perpendicular to the exterior surface of the side member 22. The predetermined position of each positioning pin 162 is selected for a specific thickness of the workpiece 2.

In operation, rotation of lever 156 in a clockwise direction as viewed in FIG. 5 moves the front edge 56 of the upper clamp means 40 towards the front edge 26 of the lower clamp means 24 to accommodate a decreased thickness of the workpiece 2.

Accordingly, rotation of lever 156 in a counter-clockwise direction as viewed in FIG. 5 moves the front edge 56 of the upper clamp means 40 away from the front edge 26 of the lower clamp means 24 to accommodate an increased thickness of the workpiece 2. By way of example, each positioning pin 162 is labeled with the indicia 164 disposed adjacently thereto which indicates a setting for a preselected thickness of workpiece 2. Furthermore, when the lever 156 has been rotated into the selected position, the positioning pin 162 is passed through the aperture 160 and the lever 156 is secured in such position with the safety pin 166 passed through the aperture (not shown) in the positioning pin 162.

The folding brake 10 may additionally include an optional hoist means, generally designated 170, for aiding in at least one of moving and positioning such workpiece 2. Preferably, such hoist means 170 includes a vertically mounted elongated base member 172 pivotally attached to one of the side members 22. A first arm 174 and a pair of laterally spaced second arms 176 are pivotally attached to the base member 172.

A frame member 180 is pivotally attached to opposed free ends of the arm 174 and each of the pair of arms 176 for swinging in a horizontal plane. A hook 182 or any other device capable of lifting workpiece 2 is connected to frame member 180. Finally, a drive means, such as a hydraulic cylinder 184 preferably of a double-acting type is pivotally connected to the arm 174 and to the base member 172 for selectively moving the hook 182 and the frame member 180 in a vertical direction. Accordingly, the control means 130 is adapted with a third control valve 138 for extending and retracting rod 185 of the cylinder 184.

Although the present invention has been shown in terms of the folding brake 10 employing hydraulically operated drive means for clamping and bending workpiece 2 and for operating hoist 170, it will be apparent to those skilled in the art, that the present invention may be applied to electric drive means. For example, electrically operated drive screw mechanisms may be employed instead of cylinders 82, 114, and 184.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A folding brake comprising:

(a) a frame having a pair of vertically disposed and spaced side members;

(b) a lower clamp means which is rigidly attached to each side member and which is disposed in a horizontal plane;

(c) an upper clamp means which is movably positioned in relationship to said lower clamp means for selectively clamping a work piece positioned onto said lower clamp means;

(d) a first pivot means for pivotally attaching a predetermined portion of said upper clamp means to a rear portion of said frame;

(e) a first drive means for generating a clamping force and for pivotally moving said upper clamp means between a first position wherein a predetermined portion of said upper clamp means abuts such work piece positioned on said lower clamp means and applies said clamping force thereto and a second position wherein said predetermined portion of said upper clamp means is disposed at a predetermined distance from such work piece for enabling selective positioning of such work piece within said folding brake;

(f) a bending means engageable with a portion of such work piece protruding beyond a front edge of said lower clamp means;

(g) a second pivot means for pivotally attaching said bending means to said frame;

(h) a second drive means for generating a bending force and pivoting said bending means in a first direction to engage such protruding portion of such work piece and apply said bending force thereto and in a second direction to disengage such bent portion of such work piece, said second drive means including:

i, a first elongated member rigidly attached to a rear portion of said each side member of said frame, ii, a second elongated member pivotally connected to said each side member of said frame, iii. at least one cylinder pivotally connected to said first elongated member at one end and pivotally connected to said second elongated member at a second end, wherein a longitudinal axis of said at least one cylinder is perpendicular to a longitudinal axis of each of said first elongated member and said second elongated member, and iv. at least one arm member pivotally connected to said second elongated member at one end and pivotally connected to said pivot means at a second end; and (i) a control means for operating said first drive means and said second drive means.

2. The folding brake, according to claim 1, wherein said upper clamp means includes:

(a) an elongated member disposed generally horizontally between said pair of said side members of said frame;

(b) a pair of vertically disposed side members;

(c) a plate like member having a rear edge rigidly attached to said elongated member and having each side edge attached to a respective one of said pair of said side members of said upper clamp means;

(d) a clamp member rigidly attached to a front edge of said plate like member and having at least a front edge thereof substantially abutting a portion of such work piece when said upper clamp means is disposed in said first position.

3. The folding brake, according to claim 2, wherein said front edge of said second elongated member is beveled.

4. The folding brake, according to claim 2, wherein said upper clamp means further includes a second plate like member having a bottom edge rigidly attached to said plate like member and having each side edge rigidly attached to said respective one of said pair of said side members of said upper claim means.

5. The folding brake, according to claim 1, wherein said first drive means includes a pair of cylinders each mounted external to a respective one of said pair of said side members and pivotally attached to said frame at one end and pivotally attached to said upper clamp means at a distal end.

6. The folding brake, according to claim 5, wherein said each cylinder is a hydraulic cylinder and said folding brake further includes a pump means for selectively supplying a hydraulic fluid pressure to said each cylinder.

7. The folding brake, according to claim 1, wherein said bending means includes an elongated member.

8. The folding brake, according to claim 7, wherein said second pivot means includes a second elongated member and a pair of bearings each secured to a respective one of said pair of said side members of said frame and engageable with a respective end of said second elongated member.

9. The folding brake, according to claim 1, wherein said second drive means includes:

(a) an elongated member rigidly attached to a rear portion of each of said side member of said frame; and (b) at least one cylinder pivotally connected to said second pivot means at one end and pivotally connected to said elongated member at a second end.

10. The folding brake, according to claim 1, wherein said folding brake further includes a guide means for guiding movement of said bending means during bending of such portion of such workpiece projecting beyond said front edge of said lower clamp means.

11. The folding brake, according to claim 1, wherein said frame further includes a vertically disposed member rigidly attached to said each side member of said frames and to said lower clamp means.

12. The folding brake, according to claim 1, wherein said control means includes a plurality of manually operated valves.

13. The folding brake, according to claim 1, wherein said folding brake further includes a hoist means for at least one of moving and positioning such work piece.

14. The folding brake, according to claim 13, wherein said hoist means includes:

(a) a vertically mounted elongated base member;

(b) a first arm having a first end pivotally attached to said base member;

(c) a pair of second arms each having a first end pivotally attached to said base member;

(d) a frame member pivotally attached to a second end of said second end of each arm, said frame singable in a horizontal plane;

(e) a hook connected to said frame member; and (f) a drive means pivotally connected to said first arm and to said base member for selectively moving said hook in a vertical direction.

15. The folding brake, according to claim 14, wherein said base member is pivotally connected to one of said pair of side members of said frame.

16. The folding brake, according to claim 1, wherein said folding brake further includes an adjusting means for adjusting position of said upper clamp means in relationship to a thickness of such work piece.

17. The folding brake, according to claim 16, wherein said thickness adjusting means includes a pair of manually operated assemblies each having:

(a) an eccentric shaft portion formed within an end of said first pivot means formed;

(b) a bearing secured to an exterior surface of a respective one of said pair of said side members of said frame for receiving said eccentric shaft portion; and a (c) an elongated lever having a first end thereof secured to an end of said eccentric shaft portion protruding beyond an exterior surface of said respective one of said pair of said side members of said frame.

18. In combination with a folding brake comprising a lower and upper clamp means and a movable work piece bending member adjacent the clamp means wherein a bending of a work piece clamped between the lower and upper clamp means is performed by the movable bending member, the improvement comprising a hoist means attached to a brake frame of said upper and lower clamp means and movable work piece bending member for at least one of moving and positioning such work piece, said hoist means including:

(a) a vertically mounted elongated base member attached to said brake frame;

(b) a first arm having a first end pivotally attached to said base member;

(c) a pair of second arms each having a first end pivotally attached to said base member;

(d) a frame member pivotally attached to a second end of said second end of each arm, said frame swingable in a horizontal plane;

(e) a hook connected to said frame member; and (f) a drive means pivotally connected to said first arm and to said base member for selectively moving said hook in a vertical direction.

19. A folding brake comprising:

(a) a frame having a pair of vertically disposed and spaced side members;

(b) a lower clamp means which is rigidly attached to each side member and which is disposed in a horizontal plane;

(c) an upper clamp means which is movably positioned in relationship to said lower clamp means for selectively clamping a work piece positioned onto said lower clamp means;

(d) a first pivot means for pivotally attaching a predetermined portion of said upper clamp means to a rear portion of said frame;

(e) a first drive means for generating a clamping force and for pivotally moving said upper clamp means between a first position wherein a predetermined portion of said upper clamp means abuts such work piece positioned on said lower clamp means and applies said clamping force thereto and a second position wherein said predetermined portion of said upper clamp means is disposed at a predetermined distance from such work piece for enabling selective positioning of such work piece within said folding brake;

(f) a bending means engageable with a portion of such work piece protruding beyond a front edge of said lower clamp means;

(g) a second pivot means for pivotally attaching said bending means to said frame;

(h) a second drive means for generating a bending force and pivoting said bending means in a first direction to engage such protruding portion of such work piece and apply said bending force thereto and in a second direction to disengage such bent portion of such work piece;

(i) a control means for operating said first drive means and said second drive means; and (j) a hoist means for at least one of moving and positioning such work piece, said hoist means including:

i. a vertically mounted elongated base member attached to said frame, ii. a first arm having a first end pivotally attached to said base member, iii. a pair of second arms each having a first end pivotally attached to said base member, iv. a frame member pivotally attached to a second end of said second end of each arm, said frame swingable in a horizontal plane, v. a hook connected to said frame member, and vi. a drive means pivotally connected to said first arm and to said base member for selectively moving said hook in a vertical direction.

20. The folding brake, according to claim 19, wherein said second drive means includes:

(a) a first elongated member rigidly attached to a rear portion of said each side member of said frame;

(b) a second elongated member pivotally connected to said each side member of said frame;

(c) at least one cylinder pivotally connected to said first elongated member at one end and pivotally connected to said second elongated member at a second end, wherein a longitudinal axis of said at least one cylinder is perpendicular to a longitudinal axis of each of said first elongated member and said second elongated member; and (d) at least one arm member pivotally connected to said second elongated member at one end and pivotally connected to said pivot means at a second end.

* * * * *